US011600910B1

(12) United States Patent
Johnson et al.

(10) Patent No.: US 11,600,910 B1
(45) Date of Patent: Mar. 7, 2023

(54) COLLAPSIBLE MONOPOLE ANTENNA FOR SPACE-DISADVANTAGED CYLINDRICAL PLATFORMS

(71) Applicant: BAE Systems Information and Electronic Systems Integration, Inc., Nashua, NH (US)

(72) Inventors: Alexander D. Johnson, Waltham, MA (US); James F. Fung, Manchester, NH (US); William K. Grefe, San Diego, CA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/644,821

(22) Filed: Dec. 17, 2021

(51) Int. Cl.

| | |
|---|---|
| ***H01Q 1/34*** | (2006.01) |
| ***H01Q 9/32*** | (2006.01) |
| ***B63G 8/00*** | (2006.01) |
| *H01Q 1/10* | (2006.01) |

(52) U.S. Cl.
CPC ..... *H01Q 1/34* (2013.01); *B63G 8/001* (2013.01); *H01Q 9/32* (2013.01); *B63G 2008/002* (2013.01); *H01Q 1/10* (2013.01)

(58) Field of Classification Search
CPC . H01Q 1/30; H01Q 1/34; B63G 8/001; B63G 2008/002
See application file for complete search history.

(56) References Cited

U.S. PATENT DOCUMENTS

| | | | | |
|---|---|---|---|---|
| 3,248,735 | A | 4/1966 | Bartolini | |
| 3,568,201 | A | 3/1971 | Spoonamore et al. | |
| 4,353,071 | A * | 10/1982 | Bernstein | H01Q 1/087 343/709 |
| 4,962,488 | A * | 10/1990 | Dell-Imagine | H04B 1/69 367/4 |
| 5,646,366 | A | 7/1997 | O'Connell | |
| 5,969,660 | A * | 10/1999 | Veazey | H01Q 15/20 342/10 |
| 6,056,237 | A * | 5/2000 | Woodland | B64C 39/024 244/49 |
| 6,392,606 | B1 | 5/2002 | French et al. | |
| 6,476,773 | B2 | 11/2002 | Palmer et al. | |
| 8,418,642 | B2 | 4/2013 | Vosburgh | |
| 8,443,750 | B2 | 5/2013 | Wiggins et al. | |

(Continued)

FOREIGN PATENT DOCUMENTS

| | | | | |
|---|---|---|---|---|
| EP | 2728666 | A1 * | 5/2014 | G01S 13/874 |
| IN | 201911009425 | | 3/2019 | |

(Continued)

*Primary Examiner* — Ab Salam Alkassim, Jr.
*Assistant Examiner* — Anh N Ho
(74) *Attorney, Agent, or Firm* — KPIP Law, PLLC; Scott J. Asmus

(57) ABSTRACT

The system for an antenna assembly for use on unmanned underwater vehicles (UUV). The antennas are low-cost, lightweight, single-use, and have a small form factor amenable to use on a micro-UUV. A central post and pivotally attached arms form an antenna (e.g., a monopole) that is lifted via an aerial, kite, or the like, when deployed from the UUV to extend the line of site of the antenna several meters above the surface of the water. In some cases, the antenna may be used on a number of UUVs in a swarm formation.

6 Claims, 7 Drawing Sheets

(56) References Cited

U.S. PATENT DOCUMENTS

| | | | | |
|---|---|---|---|---|
| 8,813,669 | B2 | 8/2014 | Race et al. | |
| 9,407,000 | B1 * | 8/2016 | Willistein | H01Q 1/30 |
| 2003/0024453 | A1 * | 2/2003 | Fonda | B63B 1/322 114/39.21 |
| 2015/0375840 | A1 | 12/2015 | Stowers | |
| 2018/0134357 | A1 | 5/2018 | Vestel et al. | |
| 2018/0149137 | A1 * | 5/2018 | Nordstrom | B64F 3/00 |
| 2021/0313668 | A1 | 10/2021 | Freebury | |

FOREIGN PATENT DOCUMENTS

| | | | | |
|---|---|---|---|---|
| WO | 2016179600 | | 11/2016 | |
| WO | WO-2016179600 | A1 * | 11/2016 | B63B 1/28 |

* cited by examiner

Deployed State

½ Deployed State

Stored State

COLLAPSIBLE MONOPOLE ANTENNA FOR SPACE-DISADVANTAGED CYLINDRICAL PLATFORMS

FIELD OF THE DISCLOSURE

The present disclosure relates to antennas and more particularly to collapsible direction finding antennas for use on space-disadvantaged cylindrical platforms, i.e. unmanned underwater vehicles.

BACKGROUND OF THE DISCLOSURE

Small form factor (<12" diameter) unmanned underwater vehicles (UUV) are a great asset to the Navy's underwater arsenal. These UUV can serve a number of communications, intelligence, surveillance, and reconnaissance (ISR), and sensing functions in either optical, acoustic, or radio frequency (RF) domains. It is known that UUV are used for carrying out naval missions. These UUV are often deployed from a larger submarine's torpedo tubes that dictate the UUV's shape. Often this requires a tube of constant diameter, with minimal radial projections from the hull of the UUV.

However to be useful in the RF domain, any communication antenna utilized must be at an extended distance above the sea surface to avoid interference and to obtain adequate signal strength. To maintain volume requirements, current solutions rely on low profile 'shark fins', surface buoys towed behind the UUV, or extendable periscopes that only protrude a few feet above the water. In order to extend line of sight (LOS) radio links, an antenna must be operated at greater heights above the water (e.g., 10+ feet).

Previous systems show the existence of large kite/aerial/balloon carried antenna, though neither overcome the above-mentioned shortcomings and drawbacks associated with the conventional antennas for use on space-disadvantaged cylindrical unmanned underwater vehicles. Namely, the ability to be stored in a small cylindrical volume and retain physical memory to operate at full efficiency after deployment has not been addressed for monopole antennas.

Wherefore it is an object of the present disclosure to overcome the above-mentioned shortcomings and drawbacks associated with the conventional antennas for use on small cylindrical platforms like unmanned underwater vehicles.

SUMMARY OF THE DISCLOSURE

One aspect of the present disclosure is an antenna assembly for use on unmanned underwater vehicles, comprising: a central post having a tethered end and a feed end; a base engaged with the central post; and a plurality of arms pivotally connected to the base, wherein the antenna assembly acts as a monopole antenna, which can be collapsed into a space-disadvantaged cylindrical platform for storage or physically deployed for an operational state.

One embodiment of the antenna assembly is wherein the plurality of arms extend away from a central post axis at an angle between 30 and 60 degrees when in a state of physical deployment.

Another embodiment of the antenna assembly is wherein the antenna is a physically reconfigurable quarter wave monopole made with polyimide fabrication elements. Where the antenna is reconfigurable since the flexible polyimide provide for the legs to fold but retain physical memory for a deployed state In some cases, the plurality of arms are pivotally attached to the base via flexible polyimide tape. In certain embodiments, the plurality of arms comprise rolled polyimide film with an outer conductive layer that are in electrical contact with the base that is in electrical contact with the signal ground.

In yet another embodiment of the antenna assembly, the central post comprises rolled polyimide film with an inner conductive layer and a wider radius end piece at the feed end, which is not in electrical contact with the with the signal ground.

Still yet another embodiment of the antenna assembly is wherein an RF connector's signal pin is in electrical contact with the central post's inner conductive layer in all physical states; and where the RF connector's ground contact is in electrical contact with antenna assembly's base only in the deployed state, further defined as when the central post's non-conductive outer layer is in physical contact with the base. In certain embodiments, when the central portion slides all the way through, it is locked into that position.

In certain embodiments of the antenna assembly, the antenna is deployed by a drag force applied to the tether, which slides the feed end of the central post toward the base, thereby extending the arms to an angle between 30 and 60 degrees and placing the antenna base in electrical contact with the RF connector's ground signal.

Another embodiment of the antenna assembly is the antenna is a physically reconfigurable quarter wave monopole made with wire fabrication elements. In certain embodiments the plurality of arms are pivotally attached to the base via flexible spring hinges. In some cases, the plurality of arms comprise conductive copper wires in electrical contact with the base. In some cases, the central post comprises a conductive copper wire.

Yet another embodiment of the antenna assembly is wherein an RF connector's signal pin is in electrical contact with the central post and where the RF connector's ground contact is in electrical contact with antenna assembly's base.

In certain embodiments of the antenna assembly, the plurality of arms are stored at a negative 90 degree angle and the antenna is deployed by a drag force applied to the tether, thereby extending the arms to an angle between 30 and 60 degrees.

Another aspect of the present disclosure is an antenna for use on unmanned underwater vehicles, comprising: an antenna assembly, comprising: a central post having a tether end and a feed end; a base engaged with the central post; and a plurality of arms pivotally connected to the base, wherein the antenna assembly acts as a monopole antenna; an aerial configured to attach to the tether end of the central post via a tether; and a radio transceiver configured to attach to the feed end of the central post via a cable.

One embodiment of the antenna is wherein the antenna resides within a UUV in its deployed state; and the UUV has a minimum inner diameter of 3-inches.

Another embodiment of the antenna is wherein the cable is coaxial and is attached to the feed end of the central post via an SMA connector.

Yet another aspect of the present disclosure is an antenna for use on unmanned underwater vehicles, comprising: an antenna assembly, comprising: a central post having a tether end and feed end; a base engaged with the central post; and a plurality of arms pivotally connected to the base, wherein the antenna assembly acts as a monopole antenna; an aerial configured to attach to the tether end of the central post via a tether; and a UUV having a radio transceiver configured to attach to the feed end of the central post via a coaxial cable.

One embodiment of the antenna is wherein the antenna resides within the UUV in its deployed state; and the UUV has a minimum inner diameter of 3-inches.

Another embodiment of the antenna is wherein the cable is coaxial and is attached to the feed end of the central post via an SMA connector.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

FIG. 1A shows an enlarged view of a portion of the aerial/kite lifted antenna for use on unmanned underwater vehicles of FIG. 1.

DETAILED DESCRIPTION OF THE DISCLOSURE

In this disclosure the problem of limited line of sight communication capabilities for UUVs is solved using aerial/kite lifted antennas. The aerial device can be a kite, an inflated balloon, a glider and the like. In order to extend line of sight (LOS) radio links, the antenna is typically operated at greater heights above the waterline (e.g., 10+ feet). The aerial/kite lifted antenna solution of the present disclosure has greater performance than existing UUV antenna deployment styles as it significantly extends the radio line of sight link budget by a factor of the sqrt(h), where h is the antenna's height off the water. For example, a 5 ft 'shark-fin' antenna that covers a 20 mi radius can be replaced by an aerial/kite lifted antenna 20 ft in the air that covers a 40 mi radius, with the assumption that the two antennas have identical antenna gain. The antenna of the present disclosure also has the extremely low size and weight requirements needed for a micro-UUV (UUV with diameter equal to or less than 3 inches). It is to be understood that this approach can be scaled or implemented in larger UUV formats as well.

The aerial/kite lifted antenna solution of the present disclosure has a small form factor well-suited for use with UUVs. Other aerial antennas have been used for communication vehicles, but these antennas are large and unscalable to a micro-UUV (diameter as low as 3 inches), for example. One embodiment of the antennas of the present disclosure deploy from a 3" diameter UUV using 'umbrella' style actuation and series line drag.

Certain embodiments of the antennas of the present disclosure can include, but are not limited to, a standard quarter wave monopole at low frequencies (e.g. VHF band), planar printed circuit monopole around WIFI band, GPS antennas, and others.

Certain embodiments of the antennas of the present disclosure can be used for applications that include, but are not limited to, direction finding (DF), signal intelligence (SIGINT), and 2-way communications. In some cases, SIGINT means intelligence-gathering via interception of signals, whether communications between people or from electronic signals not directly used in communication.

Figure 1:
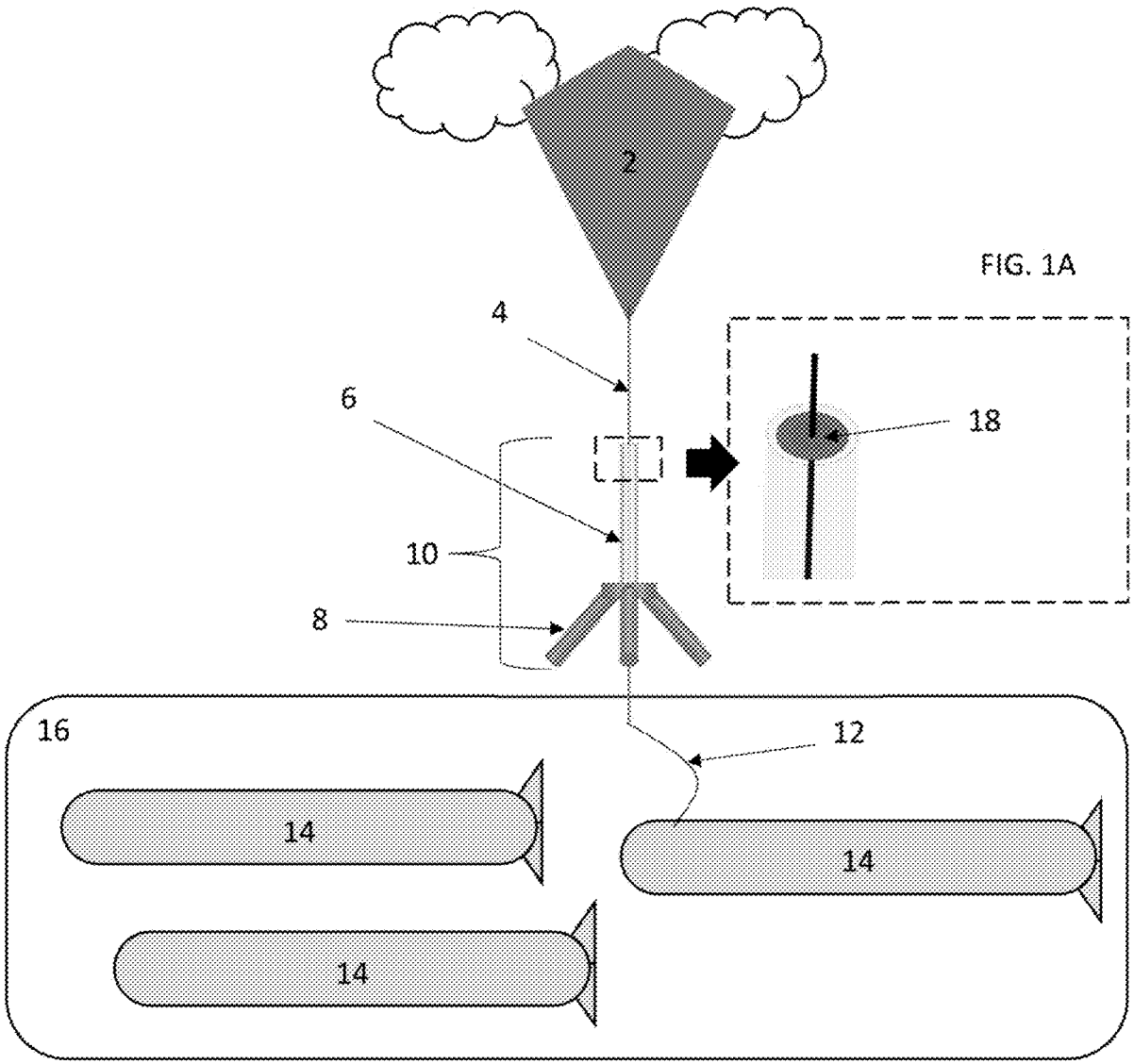
FIG. 1 shows one embodiment of an aerial/kite lifted antenna for use on unmanned underwater vehicles according to the principles of the present disclosure.

Referring to FIG. 1, one embodiment of an aerial/kite lifted antenna for use on unmanned underwater vehicles according to the principles of the present disclosure is shown. More specifically, when deployed, an aerial 2 is suspended in the air by a tether 4. In this embodiment, the aerial 2 is shown as a kite, but the concept applies to all aerials, inclusive of unmanned aerial systems (UAS), balloons, etc. The tether 4 is attached to an antenna assembly 10 at a tethered end. In one embodiment, the antenna assembly 10 includes a central post 6 and a plurality of arms 8. In one embodiment, the antenna assembly 10 is connected to a UUV 14 via a coax cable 12 at a feed end. The coax cable 12 is electrically coupled to electronics in the UUV which in one example includes a transceiver for transmitting and receiving signals. In one embodiment, the antenna 10 is a monopole operating in the automatic identification system (AIS) band, where the AIS is a system used by vessels, or the like, for identification and locating other vessels. AIS provides a means for vessels to exchange data including, but not limited to, identification, position, course, and speed, with other nearby vessels. In certain cases, multiple UUVs 14 will act as a swarm 16.

Referring to FIG. 1A, an enlarged view of a portion of the aerial/kite lifted antenna for use on unmanned underwater vehicles of FIG. 1 is shown. More specifically, in this embodiment a retaining cap 18 is used on the post 6 to secure the tether 4 to an upper portion of the antenna assembly 10. The tether 4 in one example is positioned approximately at the center of the retaining cap 18 and is long enough to allow the kite 2 to reach an altitude that is typically adequate to provide sufficient lift for the antenna 10. In one example, the tether is secured within the central post 6 to a securing hook (not shown) and the retaining cap 18 allows the tether 4 to feed out. A cable 12 electrically couples the electronics in the UUV 14 to the antenna 10. The length of the cable 12 is sufficient to position the antenna 10 above the waterline and provide for various communications. In one example the antenna system 10 is positioned more than 5 ft above the waterline and can be in the range of 10-20 ft or even above 20 ft above the waterline. The cost and manufacturing of these aerial antenna systems allow them to be attritable, meaning retrieval is not required.

Figures 2A, 2B, 2C:
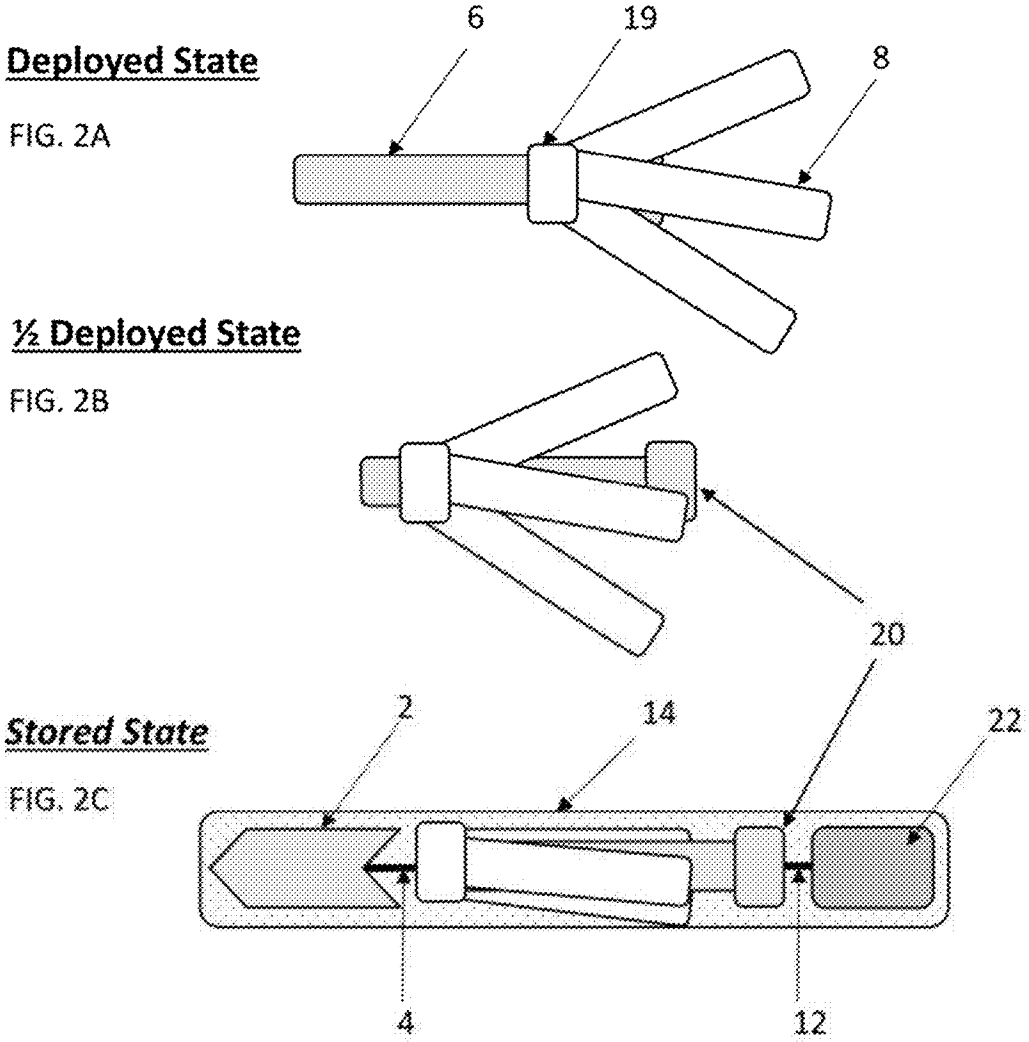
FIG. 2A shows one embodiment of an aerial/kite lifted antenna for use on unmanned underwater vehicles in a deployed state according to the principles of the present disclosure.
FIG. 2B shows one embodiment of an aerial/kite lifted antenna for use on unmanned underwater vehicles in a partially deployed state according to the principles of the present disclosure.
FIG. 2C shows one embodiment of an aerial/kite lifted antenna for use on unmanned underwater vehicles in a stored state according to the principles of the present disclosure.

Referring to FIG. 2A, one embodiment of an aerial/kite lifted antenna for use on unmanned underwater vehicles in a deployed state according to the principles of the present disclosure is shown. More specifically, when deployed, a plurality of arms 8, each having a fixed end attached to a base 19, expand outwardly away from the central post 6.

Referring to FIG. 2B, one embodiment of an aerial/kite lifted antenna for use on unmanned underwater vehicles in a partially deployed state according to the principles of the present disclosure is shown. More specifically, in a partially deployed state, an end piece 20 is visible. This end piece 20 is used to set the arm position by having a bulbous shape that is wider in diameter than the central post 6 and pushes the arms 8 outwards to an extended position shown in FIG. 2A as well as acting as a stop for the base.

Referring to FIG. 2C, one embodiment of an aerial/kite lifted antenna for use on unmanned underwater vehicles in a stored state according to the principles of the present disclosure is shown. More specifically, the UUV 14 houses the aerial/kite 2 tethered to the antenna via a tether 4, which is in turn connected to a software defined radio (SDR) transceiver 22, or the like, at the end piece 20 via a cable 12.

According to one embodiment, the UUV 14 containing the antenna system and associated electronics travels with the UUV swarm or is otherwise launched and upon a trigger, the kite and antenna system is deployed.

Figure 3:
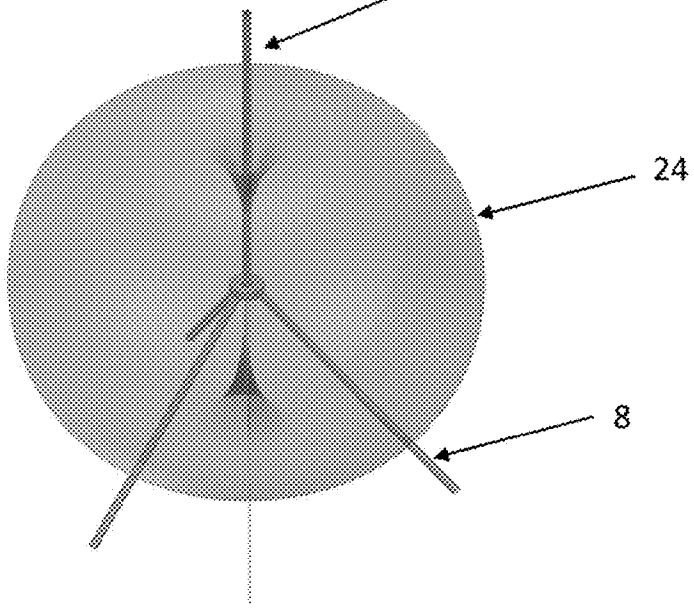
FIG. 3 is a diagram of one embodiment of an operating aerial/kite lifted antenna for use on unmanned underwater vehicles according to the principles of the present disclosure.
Figure 4:
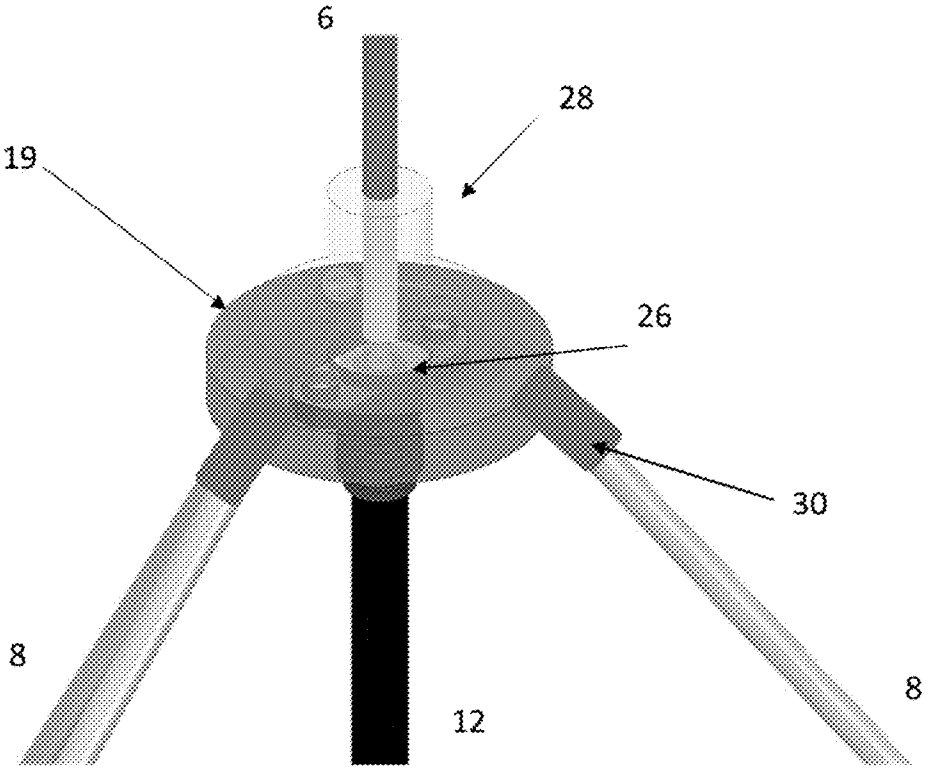
FIG. 4 shows a partial view of another embodiment of an aerial/kite lifted antenna for use on unmanned underwater vehicles in a deployed state according to the principles of the present disclosure.

Referring to FIG. 3, a diagram of one embodiment of the radiation pattern for the aerial/kite lifted antenna for use on unmanned underwater vehicles according to the principles of the present disclosure is shown. More specifically, one embodiment of an aerial/kite lifted antenna for use on unmanned underwater vehicles is shown having a central post 6 and a plurality of arms 8 forming a radiation pattern 24. The central post 6 serves as the conductor and the arms serve as the ground plane forming the monopole or resonant antenna. The length of the antenna is determined by the wavelength of the desired signals, such as 160 MHz. In one embodiment this is a monopole antenna with three quarter-wave long arms, as theory suggests is the minimum number to emulate a monopole's ground plane. The antenna in one embodiment has four arms. In one embodiment, the central post is a rolled polyimide film with an inner conductive layer and the arms are a rolled polyimide film with outer conductive layer. In this embodiment, the peak antenna gain is 0.8 dBi at 160 MHz. The base 19 is electrically conductive thereby allowing conductivity between the arms 8 and the central post 6. In one example the cable 12 from the UUV 14 is routed and coupled to the base such that it is electrically coupled to the central post and the arms. The cable 12 is long enough to allow the antenna 10 to be above the waterline such as 10 ft above the waterline. The cables inner conductor feeds the signal directly to the central post. The outer conductor of the coax cable feeds the signal ground to the antenna's base and legs Referring to FIG. 4, a partial view of one embodiment of an aerial/kite lifted antenna for use on unmanned underwater vehicles in a deployed state according to the principles of the present disclosure is shown. More specifically, in one embodiment, as modeled, the central post 6 and the plurality of arms 8 comprise ten AWG copper wire. In some cases, the base 19 is made of aluminum. In certain cases, the antenna is connected to a cable 12 via a connector 26, which is a sub-miniature coaxial cable connector such as SubMiniature version A (SMA). The SMA may be soldered and/or screwed in to the base 19. In certain embodiments, there is a polylactic acid (PLA) support 28, or the like to keep the central post 6 in position. In one embodiment, the plurality of arms 8 are connected to the base 19 via a spring hinge 30, or the like, to facilitate deploying and storage.

Figure 5:
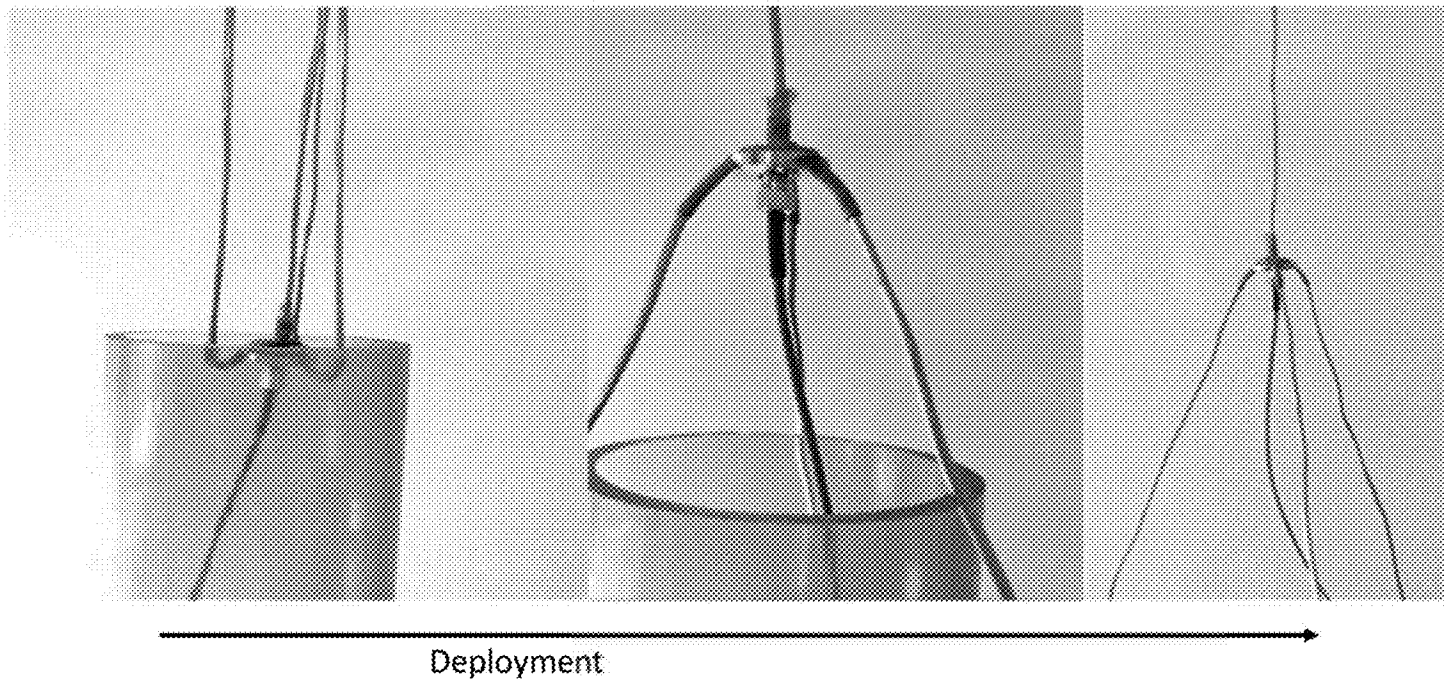
FIG. 5 shows one embodiment of an aerial/kite lifted antenna for use on unmanned underwater vehicles in the process of deploying according to the principles of the present disclosure.

Referring to FIG. 5, one embodiment of an aerial/kite lifted antenna for use on unmanned underwater vehicles in the process of deploying according to the principles of the present disclosure is shown. More specifically, spring hinges are used for pivotally connecting the plurality of arms to the base both electrically and mechanically. The spring hinges allow the mechanical storage and deployment of the given monopole antenna. In one embodiment, the antenna assembly weighs 156 g (inclusive of a 15 foot long coaxial cable).

Figure 6:
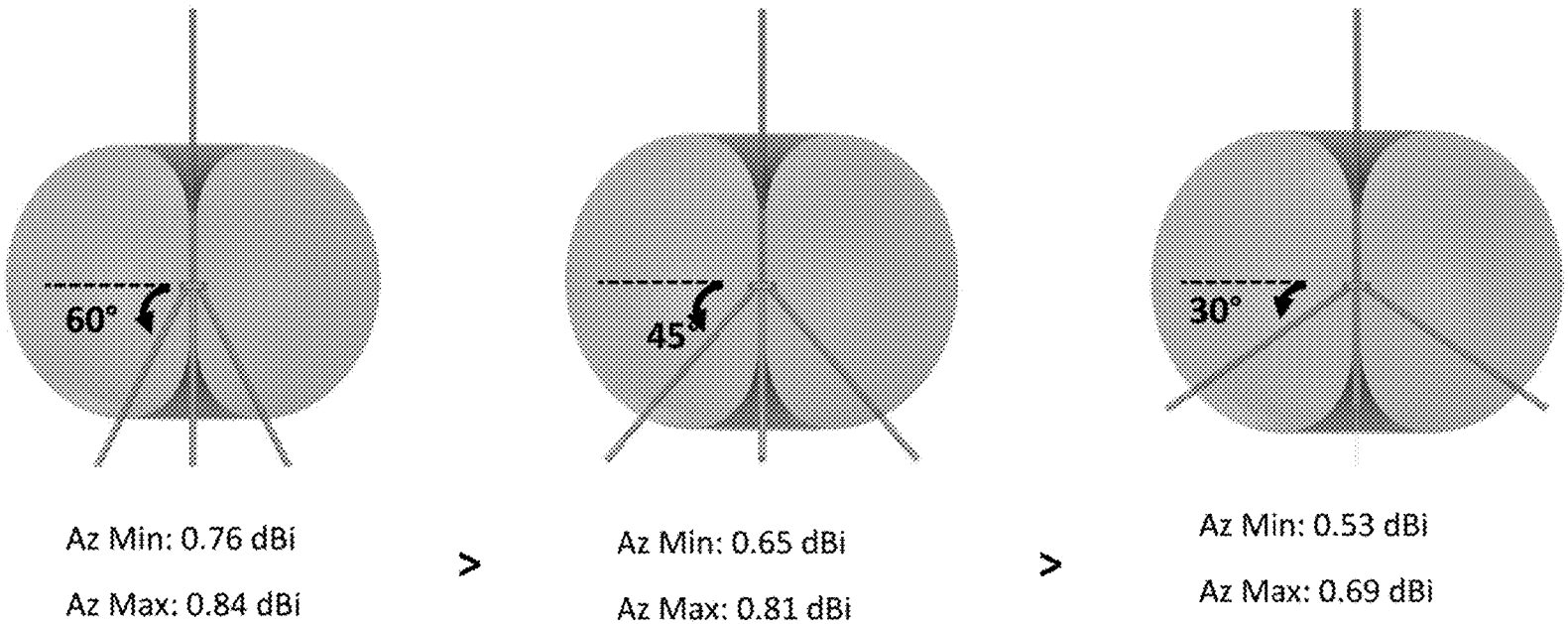
FIG. 6 is a diagram of one embodiment of an aerial/kite lifted antenna for use on unmanned underwater vehicles having varying degrees of expansion according to the principles of the present disclosure.

Referring to FIG. 6, a diagram of one embodiment of an aerial/kite lifted antenna for use on unmanned underwater vehicles having varying degrees of expansion according to the principles of the present disclosure is shown. More specifically, the arms may extend outwardly away from the central post axis at varying angles. Here, 60°, 45°, and 30° angles are shown, where the angles are measured in relation to a line perpendicular to the central axis. In other words, 60°, 45°, and 30° are, respectively, 30°, 45°, and 60° from the central post axis. In one embodiment, the antenna gain varies by no more than 0.31 dB across a 30° range of deployment angles.

Figure 7:
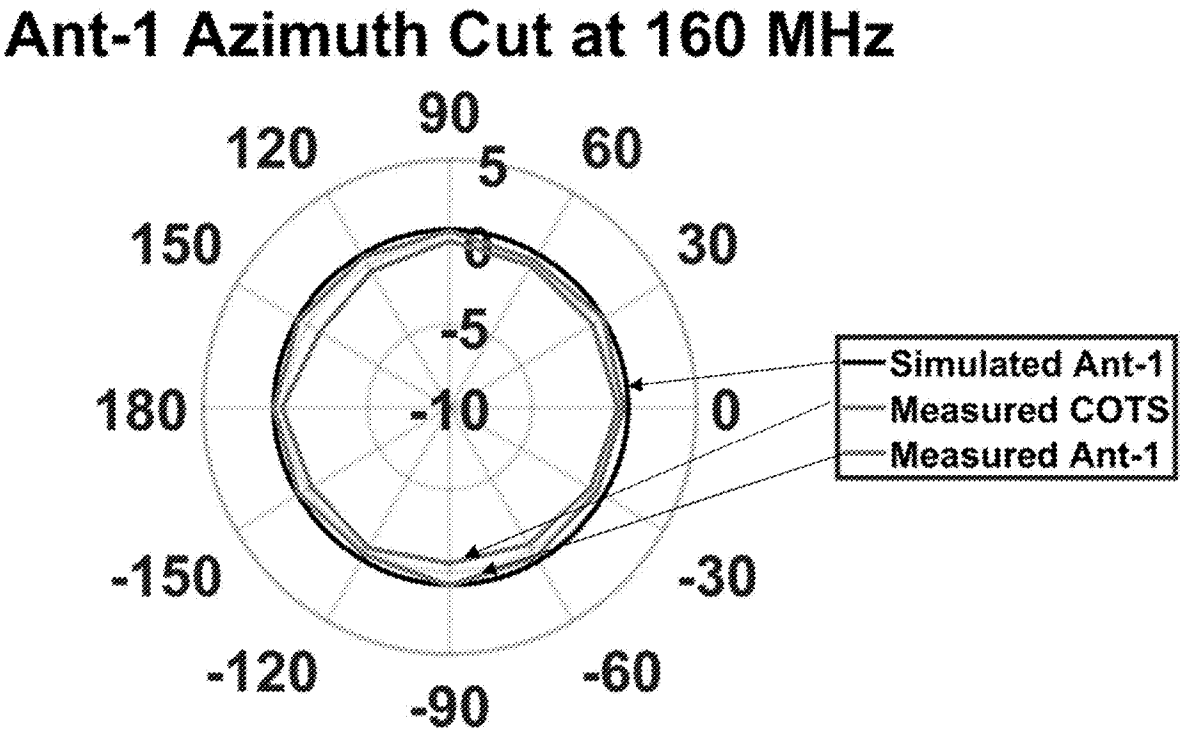
FIG. 7 is an azimuth plot one embodiment of an aerial/kite lifted antenna for use on unmanned underwater vehicles according to the principles of the present disclosure.

Referring to FIG. 7, an azimuth plot of one embodiment of an omnidirectional aerial/kite lifted antenna for use on unmanned underwater vehicles according to the principles of the present disclosure is shown. More specifically, a simulation of one 160 MHz monopole embodiment of an aerial/kite lifted antenna for use on unmanned underwater vehicles was compared to a measured embodiment and a prior art antenna. This shows that there is very close alignment to expected performance, validating the low-band monopole design. In one embodiment, multiple distributed omnidirectional antenna collaborate for advanced functions, such as direction finding.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention.

The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. An antenna system for use on unmanned underwater vehicles, comprising:

an antenna assembly, comprising:

a central post having a tether end and a feed end;

a base engaged with the central post; and a plurality of arms pivotally connected to the base, wherein the antenna assembly acts as a monopole antenna;

an aerial configured to attach to the tether end of the central post via a tether; and a UUV having a radio transceiver configured to attach to the feed end of the central post via a cable.

2. The antenna system according to claim 1, wherein the antenna assembly resides within the UUV in its stored state; and the UUV has a minimum inner diameter of 3-inches, wherein the antenna assembly is configured to operate above a waterline and the UUV is configured to house the aerial and the antenna system assembly until deployment.

3. The antenna system according to claim 1, wherein the cable is coaxial and is attached to the feed end of the central post via an SMA connector.

4. An antenna system for use on unmanned underwater vehicles, comprising:

an antenna assembly, comprising:

a central post having a tether end and feed end;

a base engaged with the central post; and a plurality of arms pivotally connected to the base, wherein the antenna assembly acts as a monopole antenna;

an aerial configured to attach to the tether end of the central post via a tether; and a UUV having a radio transceiver configured to attach to the feed end of the central post via a coaxial cable, wherein the antenna assembly is configured to operate above the waterline;

the UUV is configured to house the aerial and the antenna system assembly until deployment.

5. The antenna system according to claim 4, wherein the antenna assembly resides within the UUV in its stored state; and the UUV has a minimum inner diameter of 3-inches.

6. The antenna system according to claim 4, wherein the coaxial cable is attached to the feed end of the central post via an SMA connector.

* * * * *